US007607834B2

(12) United States Patent
Alvater et al.

(10) Patent No.: US 7,607,834 B2
(45) Date of Patent: Oct. 27, 2009

(54) PEELABLE POUCH CONTAINING A SINGLE OR MULTIPLE DOSAGE FORMS AND PROCESS OF MAKING SAME

(75) Inventors: Paul Hamilton Alvater, Lumberton, NJ (US); Thomas John Fillis, Williamstown, NJ (US)

(73) Assignee: R.P. Scherer Technologies, Inc., Las Vegas, NV (US)

( * ) Notice: Subject to any disclaimer, the term of this patent is extended or adjusted under 35 U.S.C. 154(b) by 182 days.

(21) Appl. No.: 10/910,675

(22) Filed: Aug. 2, 2004

(65) Prior Publication Data

US 2006/0023976 A1 Feb. 2, 2006

(51) Int. Cl.
*B65D 33/00* (2006.01)
*B65D 33/16* (2006.01)
*B65D 83/04* (2006.01)

(52) U.S. Cl. ..... 383/210; 383/61.1; 383/200; 206/532

(58) Field of Classification Search ..... 383/200–201, 383/61.1, 38, 210–211; 206/532
See application file for complete search history.

(56) References Cited

U.S. PATENT DOCUMENTS

| | | | | |
|---|---|---|---|---|
| 3,189,174 | A * | 6/1965 | Cormack | 206/63.3 |
| 3,419,137 | A * | 12/1968 | Walck, III | 206/364 |
| 3,768,725 | A * | 10/1973 | Pilaro | 206/439 |
| 3,809,220 | A * | 5/1974 | Arcudi | 206/484 |
| 3,930,580 | A | 1/1976 | Bazell et al. | |
| 4,011,949 | A | 3/1977 | Braber et al. | |
| 4,851,394 | A | 7/1989 | Kubodera | 514/54 |
| 5,354,551 | A | 10/1994 | Schmidt | 424/49 |
| 5,411,945 | A | 5/1995 | Ozaki et al. | 514/23 |
| 5,511,665 | A | 4/1996 | Dressel et al. | |
| 5,518,902 | A | 5/1996 | Ozaki et al. | 435/102 |
| 6,230,894 | B1 * | 5/2001 | Danville | 206/532 |

(Continued)

FOREIGN PATENT DOCUMENTS

| | | |
|---|---|---|
| CA | 2288498 | 4/2000 |

(Continued)

OTHER PUBLICATIONS

European Search Report dated Apr. 8, 2009.

*Primary Examiner*—Jes F Pascua
(74) *Attorney, Agent, or Firm*—Lowenstein Sandler PC

(57) ABSTRACT

A peelable pouch 50 for containing a single dosage product P having a top layer 100 joined to a bottom layer 200 by at least one seal 500 thereby creating a primary compartment 300. The primary compartment 300 houses the product P, sealed from the exterior environment. The peelable pouch 50 includes a tear promoting surface condition 600 on the top layer 100 and the bottom layer 200 intersected by a fold-over line 700. When the pouch 50 is folded about the fold-over line 700 the tear promoting surface condition 600 permits a user to easily tear off a portion of the pouch 50 and expose a portion of the primary compartment 300 allowing the product P to be removed from the pouch 50. Alternative embodiments incorporate a product retention edge 350 that requires supplemental separation of the top 100 and bottom 200 layers to gain access to the product P, as well as a secondary compartment 400 formed between the top 100 and bottom 200 layers.

20 Claims, 16 Drawing Sheets

U.S. PATENT DOCUMENTS

| | | | | |
|---|---|---|---|---|
| 6,338,407 | B2 * | 1/2002 | Danville | 206/532 |
| 6,655,112 | B1 | 12/2003 | Cremer et al. | |
| 6,929,399 | B2 * | 8/2005 | Nokura | 383/38 |
| 7,243,798 | B2 | 7/2007 | Buss | |
| 2001/0046540 | A1 | 11/2001 | Fioravanti et al. | |
| 2003/0075561 | A1 | 4/2003 | Pieri | |
| 2003/0121932 | A1 | 7/2003 | Wajda | 221/259 |
| 2003/0183643 | A1 | 10/2003 | Fagen et al. | 221/26 |
| 2004/0079763 | A1 | 4/2004 | Powell et al. | |
| 2004/0146222 | A1 | 7/2004 | Kinigakis et al. | |
| 2005/0045497 | A1 | 3/2005 | Sample | |
| 2007/0205127 | A1 * | 9/2007 | Barndt et al. | 206/484 |
| 2008/0105582 | A1 * | 5/2008 | Ludwig et al. | 206/438 |
| 2008/0190809 | A1 * | 8/2008 | Simon et al. | 206/532 |

FOREIGN PATENT DOCUMENTS

| | | | |
|---|---|---|---|
| DE | 202004003781 | U1 * | 6/2004 |
| NZ | 242959 | | 10/1994 |
| TW | 97820 | | 4/1988 |
| TW | 359261 | | 5/1999 |
| TW | 359652 | | 6/1999 |
| TW | 1103591 | | 2/2005 |

* cited by examiner

PEELABLE POUCH CONTAINING A SINGLE OR MULTIPLE DOSAGE FORMS AND PROCESS OF MAKING SAME

TECHNICAL FIELD

The instant invention relates to product packaging, and particularly to a process for forming a peelable pouch for individually housing single doses of a product, particularly for individually housing single doses of orally consumable films, and to the pouch formed thereby.

BACKGROUND OF THE INVENTION

Orally consumable films have become important consumer products for the dispensing of such substances as breath fresheners, anti-bacterial compounds, and various confections; and are frequently compounded with sweeteners, preservatives, and other additives. They are commonly made of water-soluble polymers, such as pullulan, as seen in U.S. Pat. Nos. 5,518,902; 5,411,945; and 4,851,394.

Presently, orally consumable films are generally distributed in reclosable packages containing ten or more doses. One dispenser adaptable for flat sheet orally consumable films is taught in U.S. Pat. Appl. Pub. No. 2003/0121932A1. This device uses a roller that can frictionally engage a flat article, such as an orally consumable strip, and dispense it through a slot in an otherwise closed container. An alternative packaging and dispensing system is seen in U.S. Pat. Appl. Pub. No. 2003/0183643A1. In that device, the orally consumable films are contained in a blister pack having an openable back portion that opens and closes the blister pack by means of a resealable pressure sensitive adhesive area. Often such packages are very small and require the user to grip and remove the solid dosage product with a single finger. To ease removal of such small, thin, lightweight products users often lick their finger to increase adhesion of the product to the finger. Obviously, such a procedure has a high probability of contaminating the other products in the packaging and has the potential of totally ruining the products from carryover saliva. Such a contact intensive removal and administration process is entirely unacceptable for medicinal products. Further, both the roller and resealable back blister pack have two serious drawbacks, namely, they are not particularly designed to prevent the dispensing of multiple film dosage forms, nor do they have any child-resistant attributes.

These drawbacks may not be of much consequence in some of the frequent uses of orally consumable films, that is, for candy, breath aids, and the like. In this setting, dosage control and safety from accidental ingestion by children is not particularly important. Representative of these packages are those taught in U.S. Pat. No. 5,354,551. However, these films have been taught as methods of dosing drugs, as for example in U.S. Pat. No. 5,411,945. In such applications, dosage control and child resistance become essential qualities of any practical packaging.

Packaging of individually contained single dosage forms, including but not limited to orally consumable films, has become increasing popular. This is true with both pharmaceutical products as well as consumer products. One obvious advantage of this in the pharmaceutical market is that it substantially reduces the risk of accidental overdose. Additionally, having the product individually wrapped, or housed, eliminates the risk of contaminating other doses of the product. Further, consumers appreciate the feeling obtained when opening an individually wrapped product because they know that they are the only one that has handled the actual product since it was packaged. Further, in this embodiment the chances of the other dosage forms becoming contaminated or losing efficacy from exposure to moisture, light or air is eliminated.

Some drawbacks come along with the benefits of individually packaged products. Perhaps the largest drawback and risk of individually packaged products is the risk posed to children. Individually wrapped products, especially small products such as medications, often resemble candy to a small child. Further, written warnings as to the contents are ineffective for children who cannot read. Most importantly, the vast majority of single dose packaging has not been child-resistant. As such, a demand for child-resistant single dose packaging has surfaced.

Present packaging technologies for individually wrapped candies and non-prescription products such as aspirin are particularly ineffective for the myriad of products that require some degree of child-resistant packaging because such candies and non-prescription product packaging has been designed solely for ease of opening. Additionally, an entirely new class of packaging is required for fast dispersing solid dosage products that are designed to dissolve when exposed to liquid. Most commonly, such fast dispersing solid dosage products are formed as a thin sheet, often less than a tenth of an inch in thickness, that is placed in the mouth to dissolve upon contact with saliva. This method of administration has become increasingly popular with prescription medications as well as consumer products such as breath fresheners. However, the key attribute that has made them popular, namely their dissolution upon contact with a liquid, has made them particularly susceptible to damage. Therefore, a process for forming individual, and individual child-resistant packaging for thin sheet fast dispersing solid dosage products is particularly needed, as well as the need for the packaging itself.

To date, great attention has been focused on designing child-resistant blister packaging for tablet and capsule products. These packages have typically been formed of a rigid transparent top layer which is sealed or otherwise bonded to a backing layer in a manner that provides a cavity, pouch, or "blister" in which the medicament is disposed. Advances in such blister packaging have included the incorporation of features requiring peeling, folding, stripping, and/or rupturing of various portions of the packaging. Unfortunately the advances made in child-resistance for such packaging has little to no relevance to applications for thin sheet type products, particularly when such products are not rigid.

What has been needed, and heretofore unavailable, is a disposable, unit dose pouch for containing thin sheet or film type products that is child-resistant, yet senior-friendly, and allows for easy opening. Such a pouch must be inexpensive and easy to manufacture, maintain the integrity of the unit dose, and must be resistant to opening by children. At the same time, the package must easily be opened by an adult user that may have limited strength, coordination, or sight.

SUMMARY OF THE INVENTION

The instant invention provides a novel peelable pouch that addresses the shortcomings of the prior art. In its most general design, the pouch comprises a top layer joined to a bottom layer by at least one seal thereby creating a primary compartment between the top layer and the bottom layer. The top layer has a peripheral edge and the bottom layer has a peripheral edge. The primary compartment houses the product (dosage form), sealed from the exterior environment, and is formed between the top layer and the bottom layer by the top layer being selectively joined to the bottom layer by the seal.

The inventive peelable pouch also includes a tear promoting feature on the top layer and the bottom layer located substantially on a line that traverses a portion of the primary compartment. When the pouch is folded about a fold-over line the tear promoting surface condition or feature permits a user to easily tear off a portion of the top and bottom layers to expose a portion of the primary compartment.

Once a portion of the primary compartment has been exposed, the product may then be removed from the pouch. Alternative embodiments incorporate a product retention edge that requires supplemental separation of the top and bottom layers to gain access to the product. The product retention edge is configured such that the product is retained in the primary compartment even after the primary compartment has been exposed to the exterior environment by the use of the tear promoting feature to remove a portion of the top layer and the bottom layer. The product retention edge essentially creates a projection extending inwardly in the primary compartment thereby creating a choke-point, or neck, that is narrower than the product is vide, so that the product cannot accidentally exit the primary compartment regardless of the orientation that the pouch is held during the initial opening.

The product retention edge necessitates the additional step of peeling apart a portion of the seal in the vicinity of the product retention edge to gain access to the product. This additional step imparts additional safety to the pouch and further increases the child resistance of the pouch. Adults, including senior citizens, can easily grip the top layer and the bottom layer between their thumbs and forefingers and separate the layers thereby peeling apart a further portion of the seal and gain access to the product.

Another embodiment of the peelable pouch incorporates a secondary compartment. Similar to the primary compartment, the secondary compartment is formed between the top layer and the bottom layer by the top layer being selectively joined to the bottom layer by a peelable seal. The secondary compartment is adjacent to the primary compartment and separated from the primary compartment by a portion of the seal. In this embodiment, the fold-over line traverses a portion of the secondary compartment. When the pouch is folded about the fold-over line, the tear promoting surface condition permits a user to easily tear off a portion of the top and bottom layers to expose a portion of the secondary compartment. Once a portion of the secondary compartment is exposed, a user may easily grip the top surface and the bottom surface to peel them apart and separate the portion of the seal separating the primary compartment from the secondary compartment, thereby gaining access to the product. This dual compartment embodiment enhances the child-resistance of the pouch and improves the integrity of the packaging since at least two seals must be compromised before the product is exposed to the surrounding environment. The secondary compartment may house a second product. For example, one can readily appreciate that the secondary compartment may house antibacterial hand washing solution or a towelette that may be used to clean a user's hands prior to handling the product in the primary compartment.

Thus, there is disclosed a peelable pouch for containing at least one product, comprising:

a top layer having a peripheral edge, an interior surface, and an exterior surface;

a bottom layer having a peripheral edge, an interior surface, and an exterior surface;

a primary compartment housing the product, sealed from the exterior environment, formed between the top layer and the bottom layer by the top layer being selectively joined to the bottom layer by a seal, the primary compartment having a peripheral boundary along the seal;

a secondary compartment formed between the top layer and the bottom layer by the top layer being peelably joined to the bottom layer by the seal, the secondary compartment being adjacent to the primary compartment and separated from the primary compartment by a portion of the seal, the secondary compartment having a peripheral boundary along the seal; and a tear promoting surface condition on the top layer and the bottom layer intersecting a fold-over line such that when the pouch is folded about the fold-over line the tear promoting surface condition permits a user to easily tear off a portion of the top and bottom layer to expose a portion of the secondary compartment so that a user may easily grip the top surface and the bottom surface to peel them apart to separate the portion of the seal separating the primary compartment from the secondary compartment, thereby gaining access to the product.

The inventive package may contain products other than dosage forms, i.e. confections, contact lenses, and the like. In one embodiment, multiple products may be contained in the primary compartment. In similar form, the inventive package may contain multiple dosage forms such as films, pills and soft capsules. In a most preferred embodiment, the inventive package contains single dosage forms, yet more preferably, single sheet dosage forms.

There is further disclosed a process for forming a single dose peelable pouch for containing a single dosage product comprising the steps of:

providing bulk single dosage product;

concurrently providing two opposing sheets of pouch material comprising a top layer and a bottom layer;

placing a plurality of single dosage products between the top layer and bottom layer of pouch material in a predetermined pattern, creating areas wherein the top layer and bottom layer of pouch material are separated by single dosage product and areas where the top layer and bottom layer of pouch film material may directly touch;

applying sealing means to a portion of the top layer and bottom layer of pouch film material such that sealing occurs in areas where the top layer and bottom layer of pouch material are touching without intervening product;

sealing a portion of the top layer and bottom layer of pouch material to enclose at least one of the single dosage product in at least one closed pouch comprising at least one primary compartment having a peripheral boundary, sealed from the environment, thereby creating a plurality of closed pouches further comprising at least a primary compartment containing the single dosage product;

forming a tear promoting surface condition in each of the plurality of closed pouches;

cutting the plurality of closed pouches into a plurality of individual closed pouches; and discharging the plurality of individual closed pouches ready for secondary packaging.

There is also disclosed a process for forming a single dose peelable pouch for containing a single dosage product comprising a single strip of orally consumable film comprising the steps of:

providing bulk orally consumable film strip in roll form;

unwinding the bulk orally consumable film strip under tension;

slitting the bulk orally consumable film strip into a plurality of strips of lesser width;

cutting each of the plurality of strips into a plurality of single dosage film strips;

concurrently providing two opposing sheets of pouch material comprising a top layer and a bottom layer;

placing a plurality of single dosage film strips between the top layer and bottom layer of pouch material in a predetermined pattern, creating areas wherein the top layer and bottom layer of pouch film material are separated by single dosage film strips and areas where the top layer and bottom layer of pouch film material may directly touch;

applying sealing means to a portion of the top layer and bottom layer of pouch material such that sealing occurs in areas where the top layer and bottom layer of pouch material are touching without intervening product;

sealing a portion of the top layer and bottom layer of pouch material to enclose at least one of the single dosage film strip in at least one closed pouch comprising at least one primary compartment having a peripheral boundary, sealed from the environment, thereby creating a plurality of closed pouches;

forming a tear promoting surface condition in each of the plurality of closed pouches;

cutting the plurality of closed pouches into a plurality of individual closed pouches; and discharging the plurality of individual closed pouches ready for secondary packaging.

BRIEF DESCRIPTION OF THE DRAWINGS

Without limiting the scope of the present invention as claimed below and referring now to the drawings and figures:

Also, in the various figures and drawings, the following reference symbols and letters are used to identify elements described herein in connection with several figures and illustrations: P, R.

DETAILED DESCRIPTION OF THE INVENTION

The peelable pouch of the instant invention provides a significant advancement in the state of the art. The preferred embodiments of the inventive dosage delivery system accomplish this by new and novel arrangements of elements that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
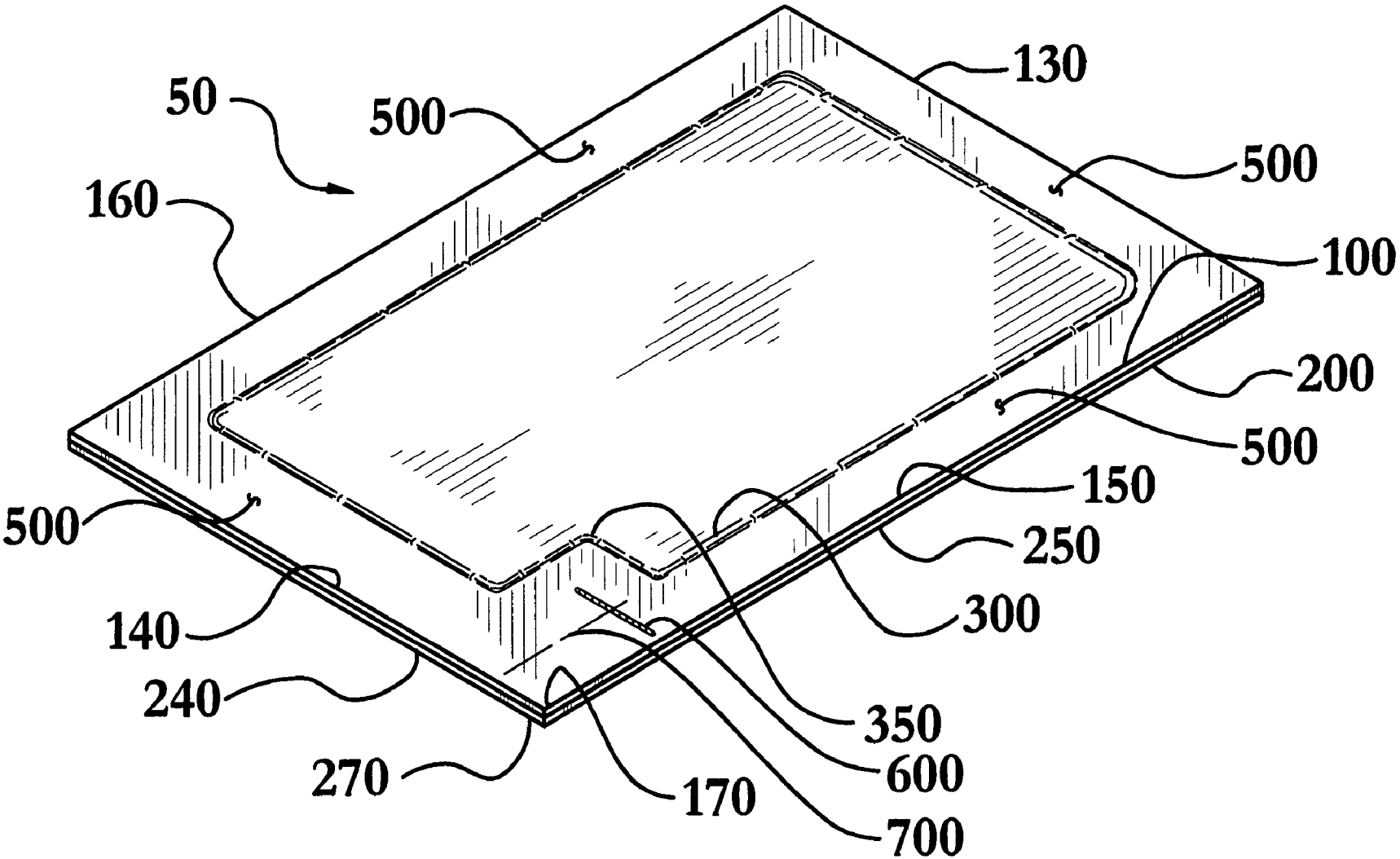
FIG. 1 shows a representative peelable pouch in elevated perspective, not to scale.

With reference now to FIG. 1, the instant invention is a peelable pouch 50 containing a single dosage product P, preferably a fast dispersing film dosage form. The peelable pouch 50 includes a top layer 100 joined to a bottom layer 200 by at least one seal 500 thereby creating a primary compartment 300 between the top layer 100 and the bottom layer 200, illustrated best in FIG. 7. The top layer 100 has a peripheral edge 170 and the bottom layer 200 has a peripheral edge 270. While the embodiments illustrated in the figures are generally rectangular in shape, one with skill in the art will recognize that the peripheral edges 170, 270 may be any shape.

Figure 7:
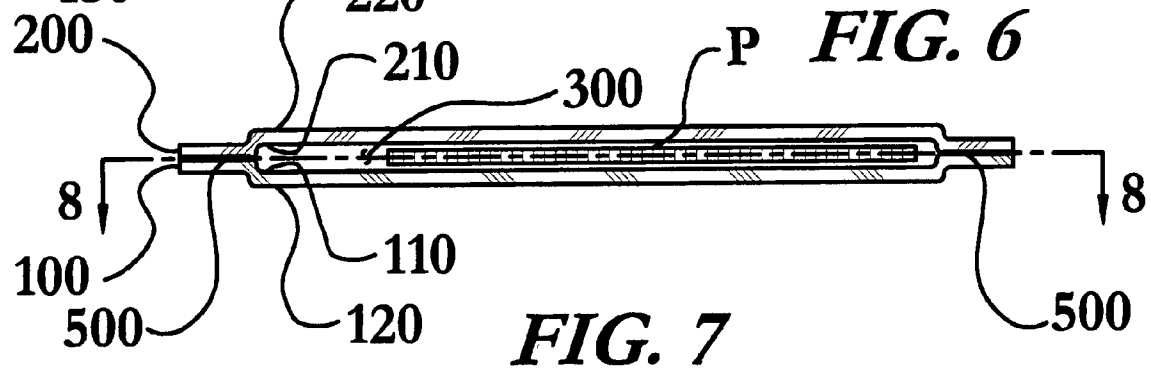
FIG. 7 shows a cross-sectional view, taken along section line 7-7 in FIG. 6, not to scale.

The top layer 100 has an interior surface 110, in contact with the primary compartment 300, and an exterior surface 120, in contact with the surrounding environment, shown best in FIG. 7. Similarly, the bottom layer 200 has an interior surface 210, in contact with the primary compartment 300, and an exterior surface 220, in contact with the surrounding environment.

Figure 6:
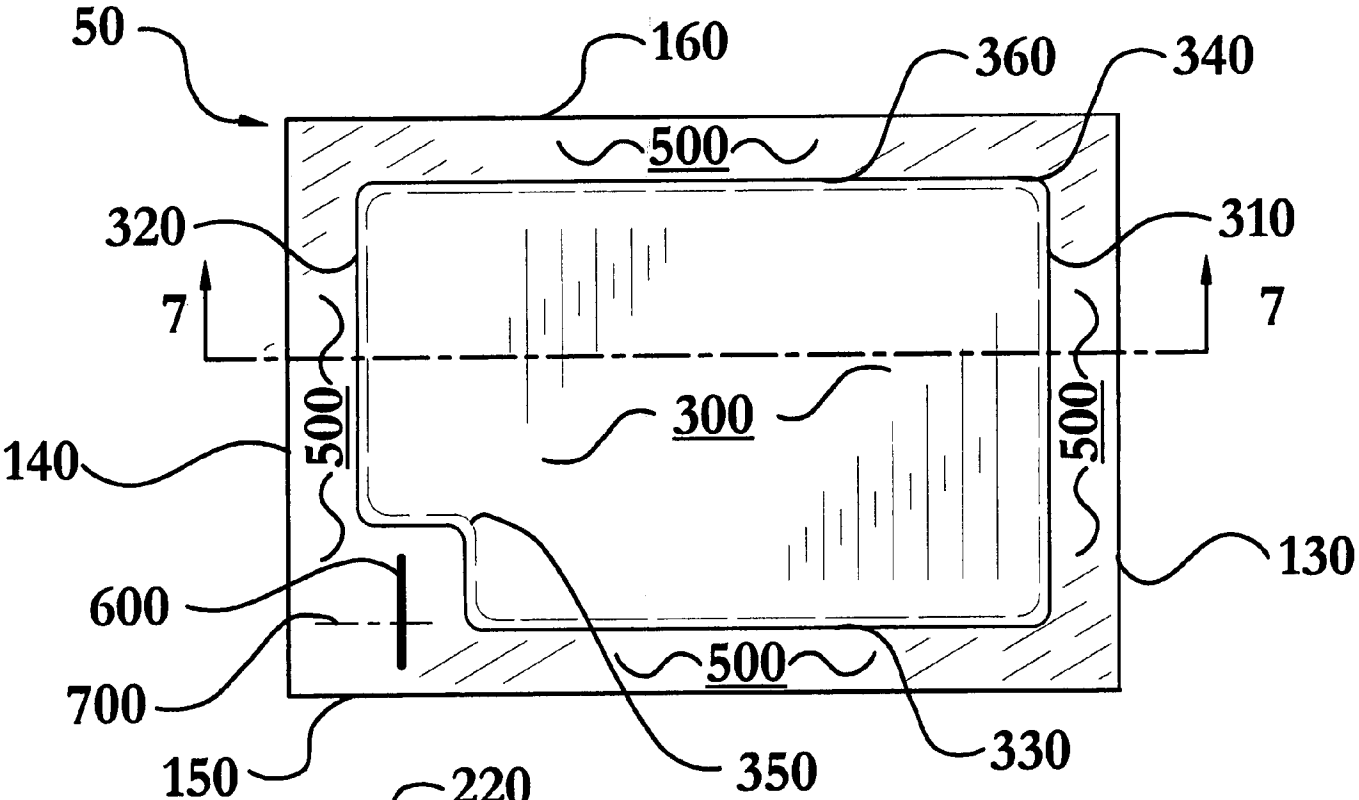
FIG. 6 shows a top plan view of the peelable pouch shown in FIG. 1, not to scale.

The primary compartment 300 houses the product P, sealed from the exterior environment, and is formed between the top layer 100 and the bottom layer 200 by the top layer 100 being selectively joined to the bottom layer 200 by the peelable seal 500. The primary compartment 300 has a peripheral boundary 360 along the seal 500, as seen in FIG. 6. As with the peripheral edges 170, 270, the peripheral boundary 360 of the primary compartment 300 may be any shape, including a shape designed to mimic the shape of the product P, or a shape selected for ease of use in opening the pouch 50.

Figure 8:
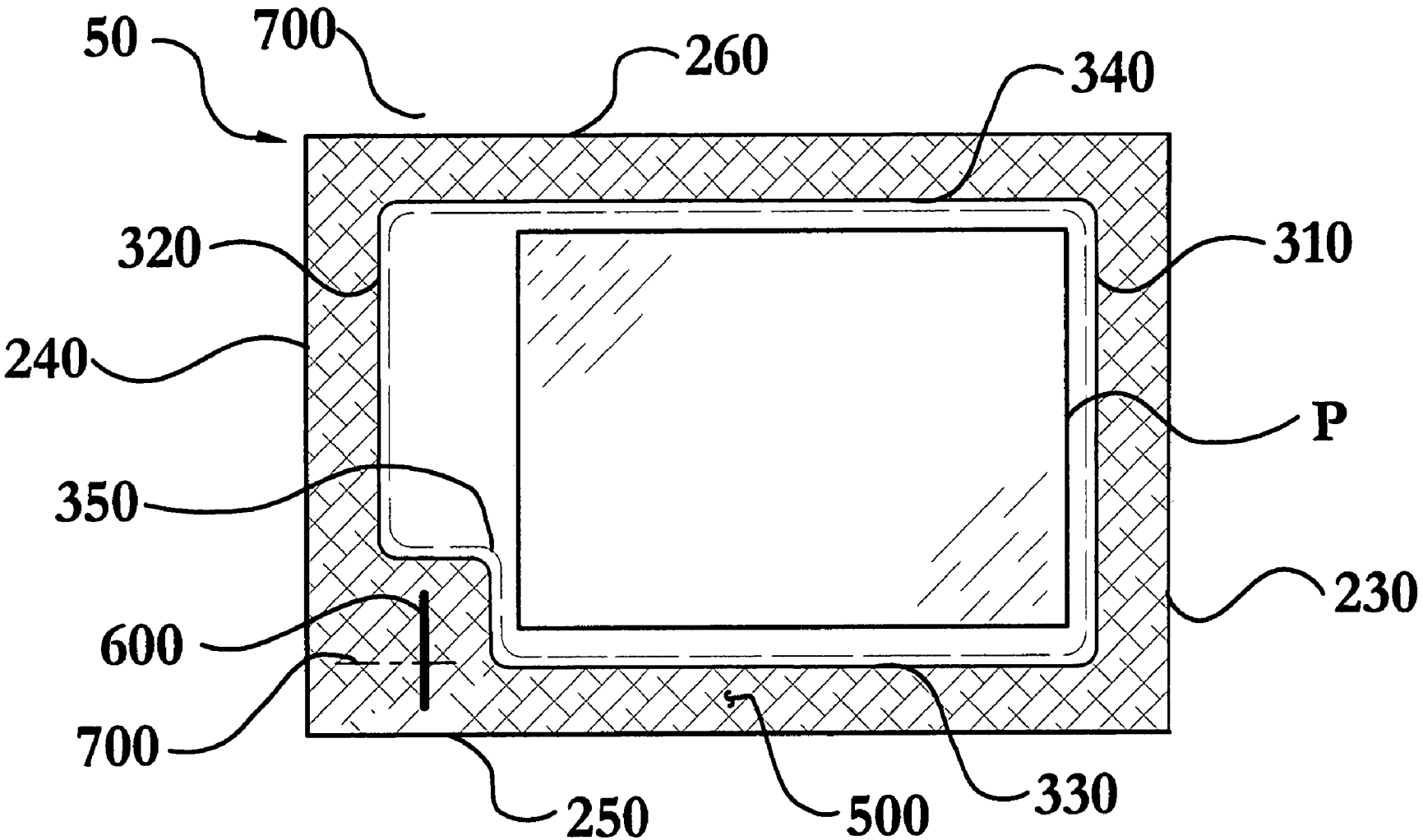
FIG. 8 shows a cross-sectional view, taken along section line 8-8 in FIG. 7, not to scale.

In the generic rectangular embodiment illustrated in FIGS. 1 through 17, the top layer 100 has a proximal edge 140, a distal edge 130, relative to the pouch opening means or tear promoting surface conditions 600. This embodiment also has a first lateral edge 150, and a second lateral edge 160, best illustrated in FIG. 6. Similarly, the bottom layer 200 has a proximal edge 240, a distal edge 230, a first lateral edge 250, and a second lateral edge 260, best illustrated in FIG. 8. Generally, the seal 500 joins the proximal edges 140, 240, the distal edges 130, 230, the first lateral edges 150, 250, and the second lateral edges 160, 260, of the top layer 100 and the bottom layer 200 to define the primary compartment 300 peripheral boundary 360. In such a rectangular embodiment, the peripheral boundary 360 includes a proximal boundary 320, a distal boundary 310, a first lateral boundary 330, and a second lateral boundary 340. While the seal 500, perhaps best illustrated in FIG. 8, is generally illustrated as a single continuous seal, the seal 500 may be comprised of a number of separate and distinct seals that cooperate to form the primary compartment 300.

The seal 500 may be created by virtually any material joining technology. Most commonly, the seal 500 will be at least one fusion seal created under elevated temperature and pressure; however, it may also be a mechanical or chemical seal. Such a mechanical seal could include, by way of example and not limitation, crimping and various retainer clips; and such thermal or chemical seals could include, by way of example and not limitation, adhesive bonds such as chemical adhesive or hot melt techniques, or other fusion methods. The seal 500 is selected to be strong enough that it cannot be easily separated by a small child, yet can be opened without difficulty by the elderly.

The materials from which the inventive pouch may be constructed include laminations that are manufactured from a wide variety of substrates to provide atmospheric, moisture and light barriers. These include extrusion coated and laminated films, coextruded films, foil laminations, and extrusion coated and laminated paper. The preferred material is a multi-layered, aluminum foil-based material that easily seals (thermally) and easily peels.

Representative materials useful in forming the inventive pouches include Integra® Peel LFM and LFM Peelable Foil Laminate from Amcor Flexibles of Mundelein, Illinois. These materials are coated aluminum foil that preferably have a child resistant polyester coating on the outside, can be hermetically sealed and have peelable opening capabilities.

Further, while the top 100 and bottom 200 layers have been illustrated and described as separate distinct articles, one with skill in the art will recognize that the top layer 100 and the bottom layer 200 may be formed from a common substrate folded over at either the proximal edge 140, 240, the distal edge 130, 230, the first lateral edge 150, 250, or the second lateral edge 160, 260, creating a folded edge thereby not requiring the seal 500 along the folded edge. In such an embodiment, the three sealed edges and the folded edge define the primary compartment 300 peripheral boundary 360 to include a proximal boundary 320, a distal boundary 310, a first lateral boundary 330, and a second lateral boundary 340.

Figure 2:
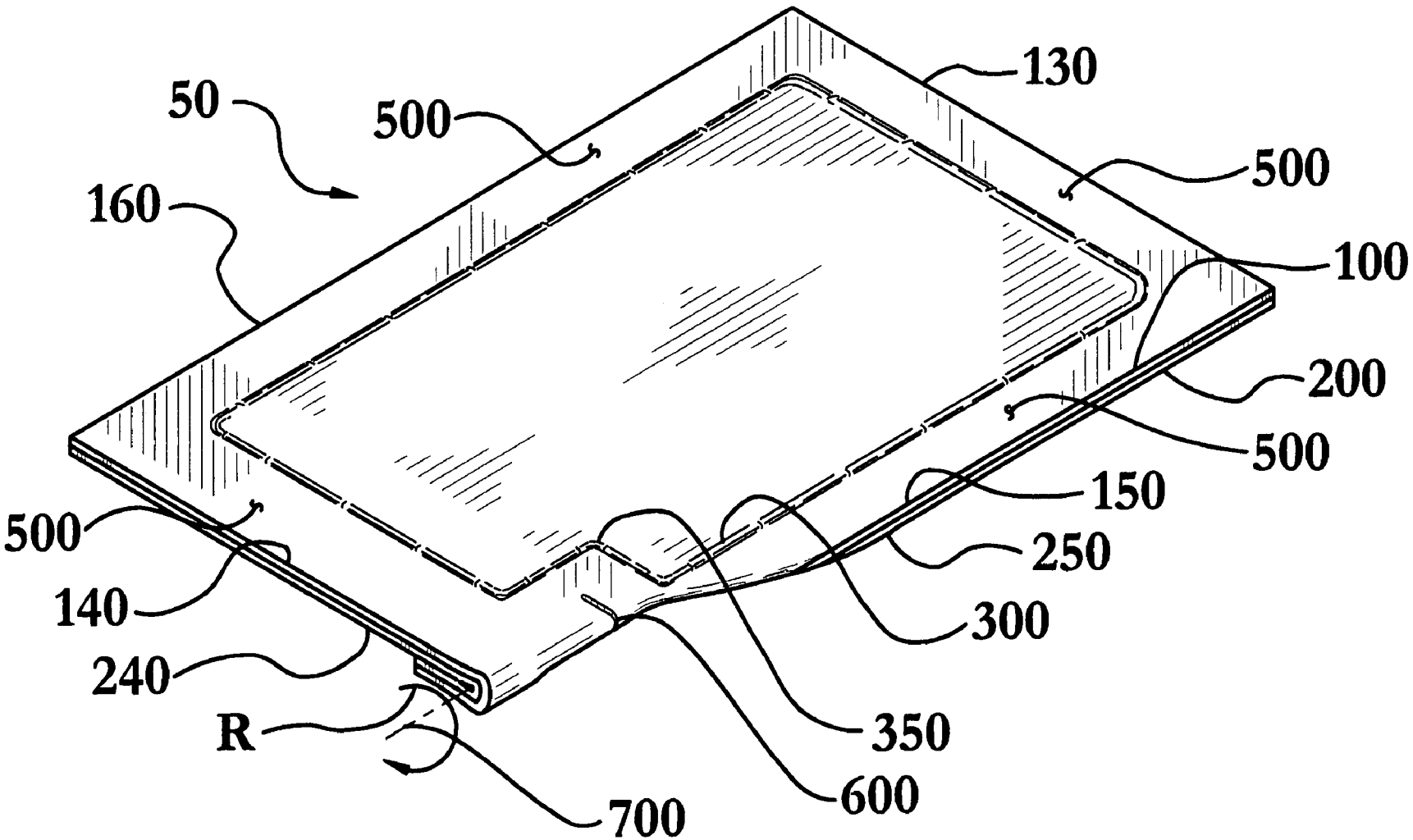
FIG. 2 shows a representative peelable pouch in elevated perspective in the folded configuration, not to scale.
Figure 3:
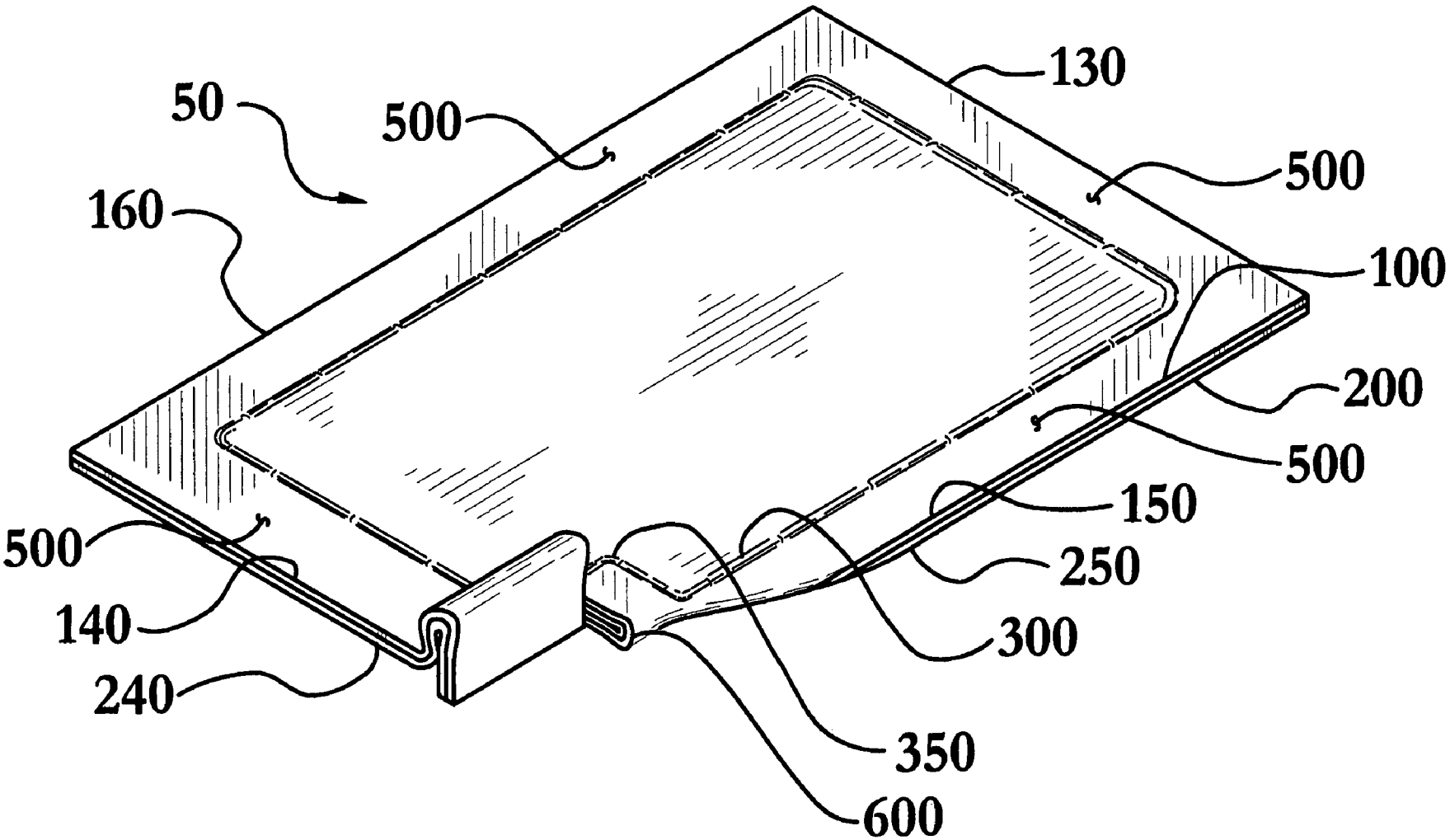
FIG. 3 shows a representative peelable pouch in elevated perspective view having an end portion folded, with tearing initiated, not to scale.
Figure 4:
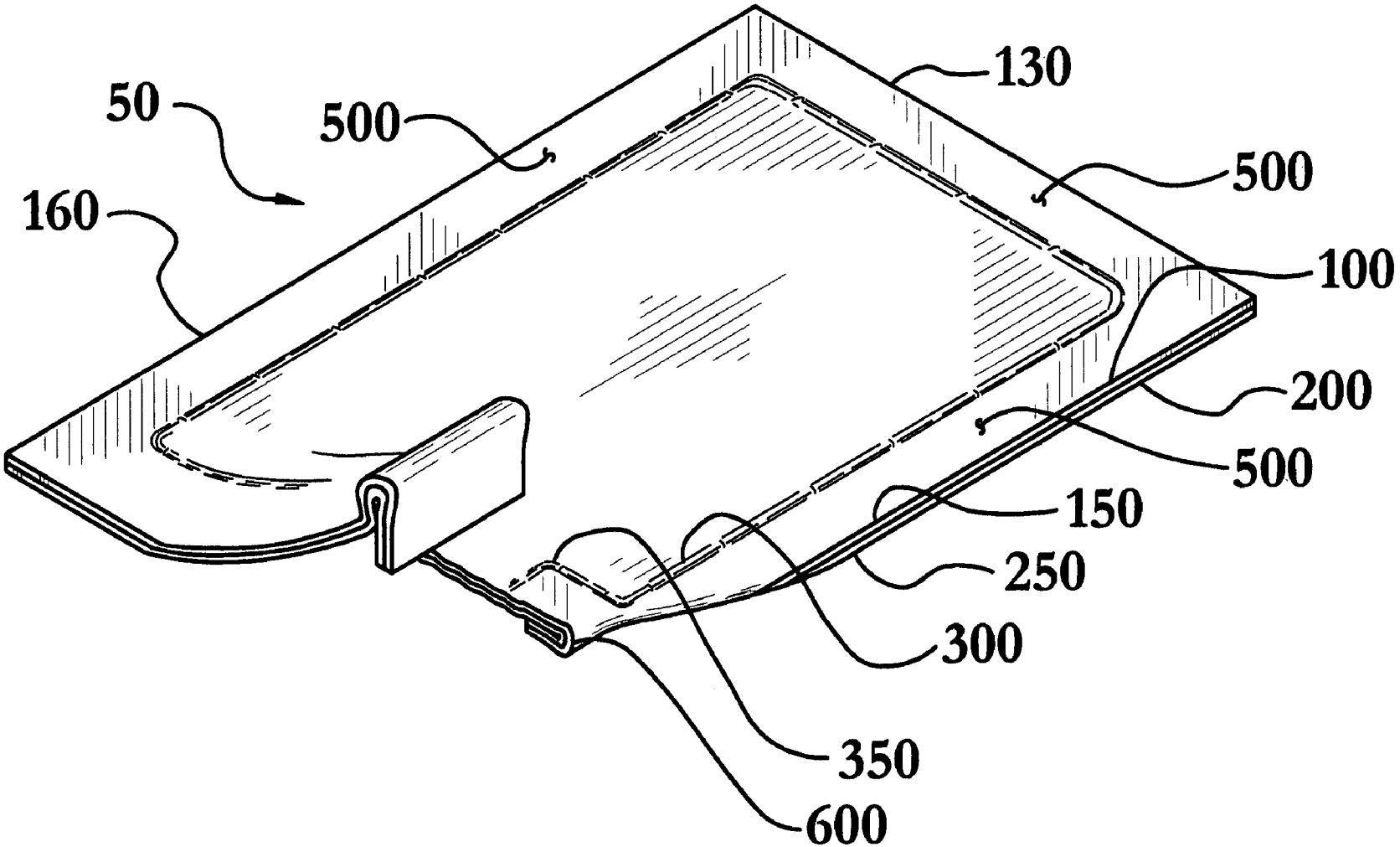
FIG. 4 shows a representative peelable pouch in elevated perspective view partially torn, not to scale.

The peelable pouch 50 also includes a tear promoting surface condition 600, which can be of any size or orientation, on the top layer 100 and the bottom layer 200 located substantially near a fold-over line 700. The fold-over line 700 generally intersects the tear promoting surface condition 600, and is illustrated in FIGS. 1 through 17 as substantially orthogonal to the longest side of the tear promoting surface condition 600. In other embodiments, the fold over 700 could intersect the tear promoting surface condition 600 at any angle, provided the user can get the package open. When the pouch 50 is folded about the fold-over line 700, as seen in FIG. 2, the tear promoting surface condition 600 is presented and permits a user to easily upturn a portion of the pouch 50, as seen in FIG. 3. The upturned portion may then be easily grasped and pulled to tear off a portion of the top 100 and bottom 200 layers to expose a portion of the primary compartment 300, as seen in FIG. 4.

Child-resistance is provided by the pouch 50 in that it is opened only after simultaneous and complex movement sequences have been performed, which would not be obvious to a small child. For instance, the pouch 50 is exceedingly difficult to tear open without first folding it along the fold-over line 700 and exposing the tear promoting surface condition 600. In one embodiment, the tear promoting surface condition 600 is a tear slit 610 that extends through the top layer 100 and the bottom layer 200 in an area of the seal 500. Alternatively, the tear promoting surface condition 600 may simply be an indentation in the surface of each layer 100, 200, a penetration of any shape extending through each layer 100, 200, areas of reduced thickness of the layers 100, 200, or areas of different material formed in the layers 100, 200. The tear promoting condition 600 could also encompass a tear string or other integral tearing structure, as would be known to one skilled in the art.

Once a portion of the primary compartment 300 has been exposed by the removal of a portion of the top 100 and bottom 200 layers the product P may then be removed from the pouch 50 or supplemental separation of the top 100 and bottom 200 layers may need to occur in embodiments incorporating a product retention edge 350. As seen in FIGS. 1 through 6, the product retention edge 350 may be formed in the peripheral boundary 360 of the primary compartment 300. The product retention edge 350 is configured such that the product P is retained in the primary compartment 300 after the primary compartment 300 has been exposed to the exterior environment by the removal of a portion of the top layer 100 and the bottom layer 200, best illustrated in FIG. 8. The product retention edge 350 essentially creates a projection extending inwardly in the primary compartment 300 thereby creating a choke-point, or neck that is narrower than the product P is wide so that the product P cannot accidentally exit the primary compartment 300 regardless of the orientation that the pouch 50 is held.

Figure 5:
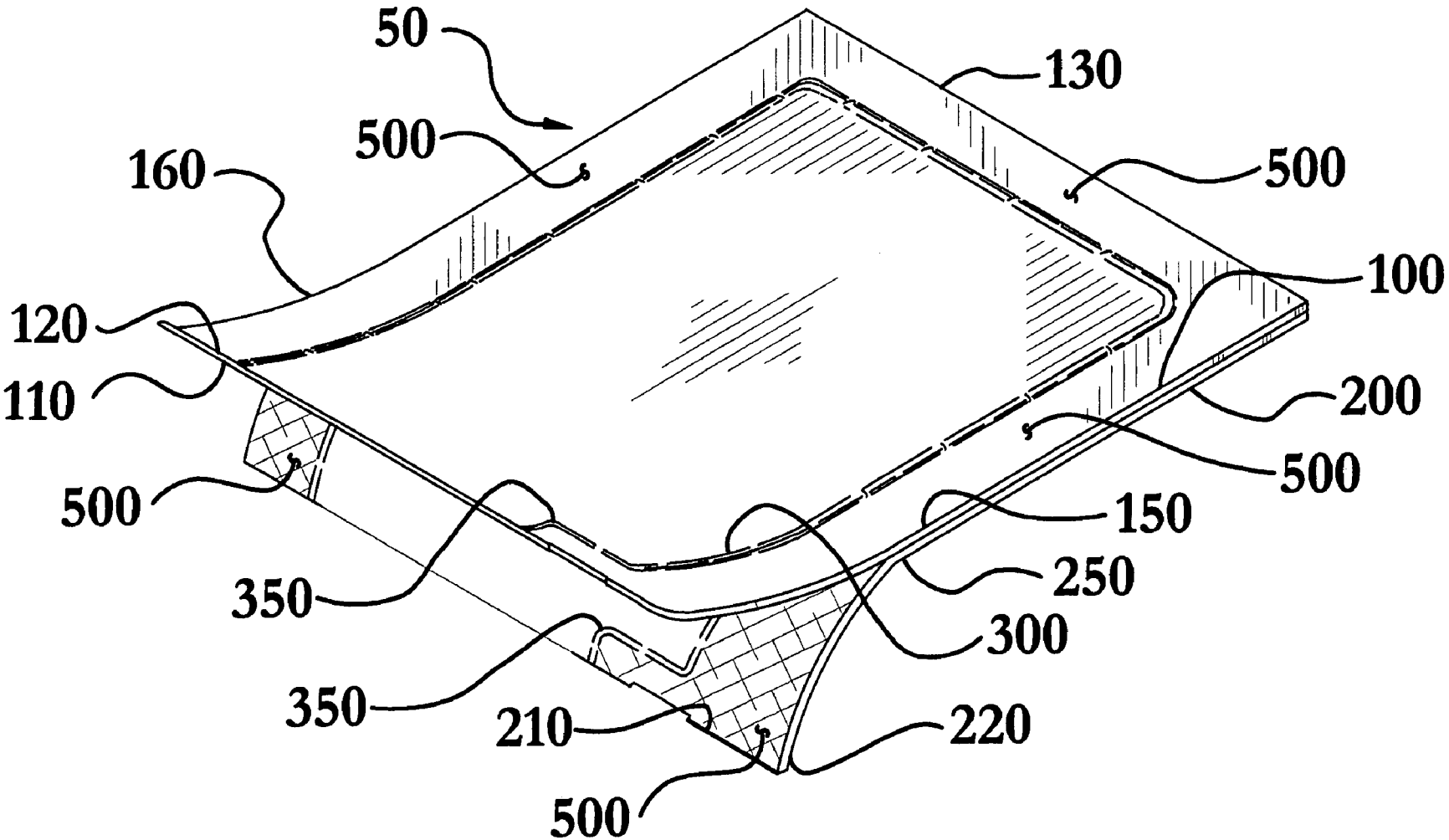
FIG. 5 shows a representative peelable pouch in elevated perspective view fully torn and partially peeled, not to scale.
Figure 9:
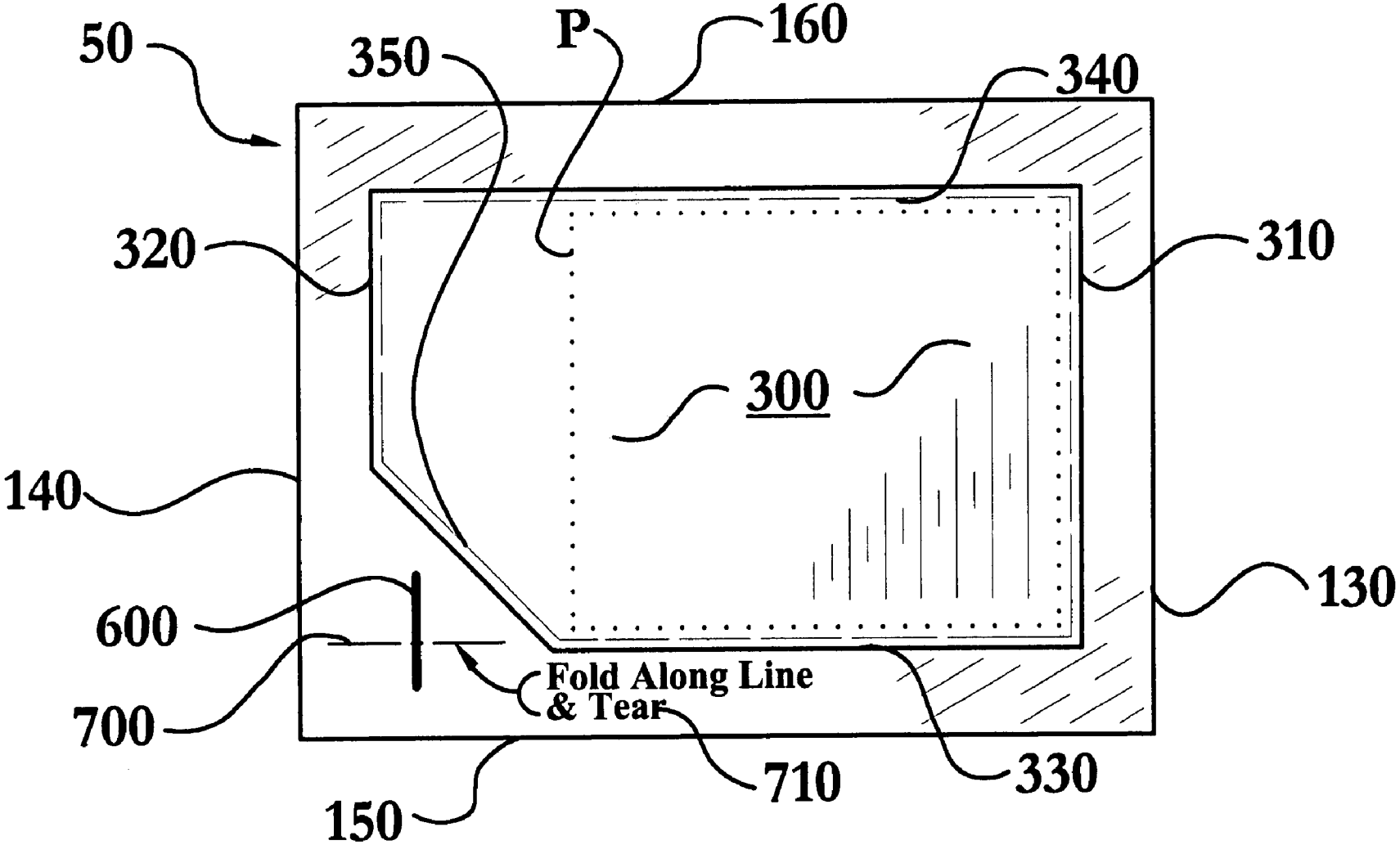
FIG. 9 shows a top plan view of a representative alternative embodiment of a peelable pouch, not to scale.
Figure 10:
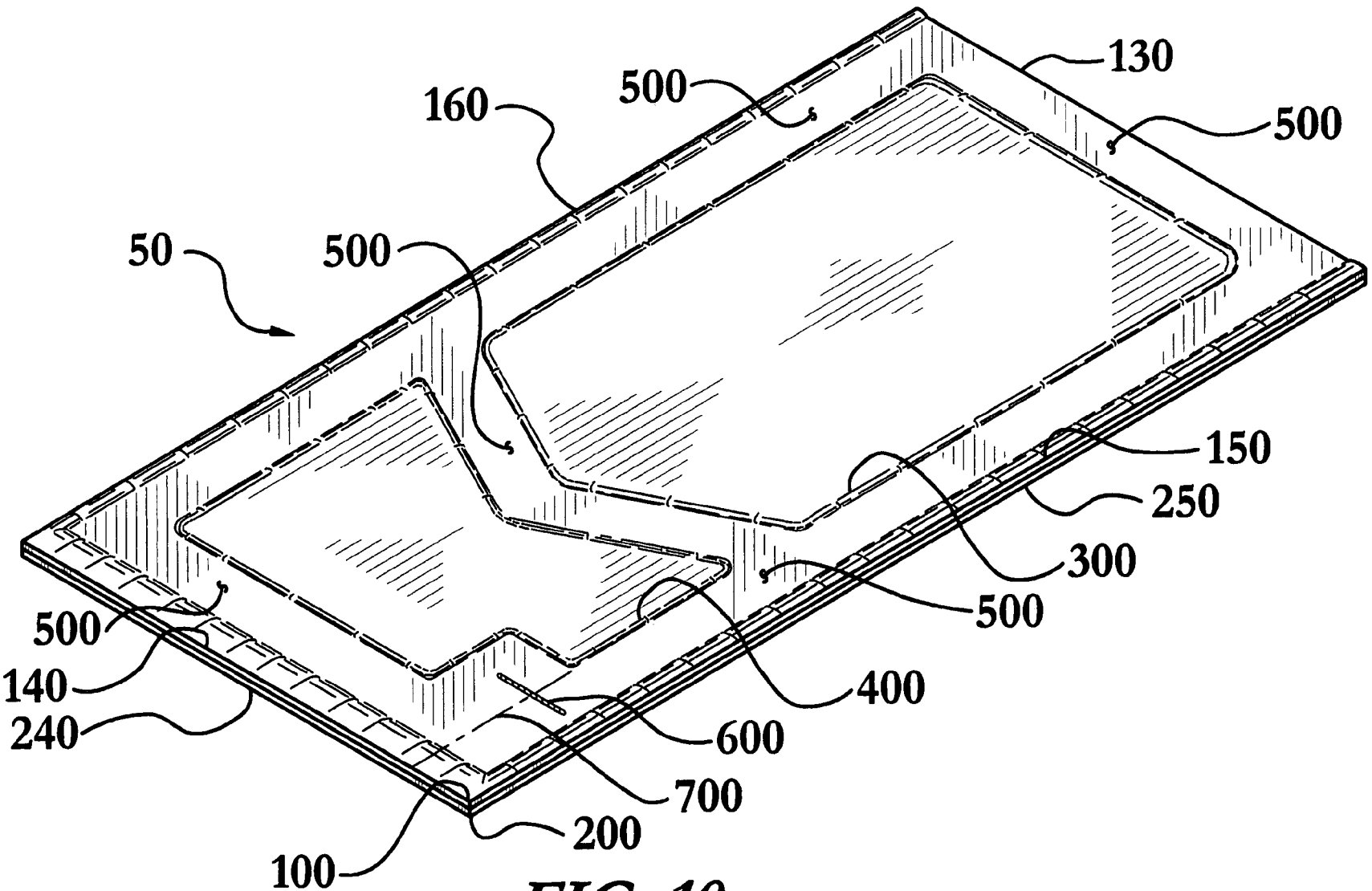
FIG. 10 shows a representative dual compartment peelable pouch in elevated perspective view, not to scale.

Further, the product retention edge 350 thereby necessitates the additional step of peeling apart a portion of the seal 500 in the vicinity of the product retention edge 350 to gain access to the product P, illustrated in FIG. 5. This additional step imparts additional safety to the pouch 50 and further increases the child resistance of the pouch 50. Adults, including senior citizens, can easily grip the top layer 100 and the bottom layer 200 between their thumbs and forefingers and separate the layers 100, 200 thereby peeling apart a portion of the seal 500 and gaining access to the product P. While the product retention edge 350 of FIGS. 1 through 8 is substantially orthogonal to the lateral boundaries 330, 340 of the primary compartment 300, the product retention edge 350 may take any number of forms. One such variation is illustrated in FIG. 9 where the product retention edge 350 is a chamfered edge between the first lateral boundary 330 and the proximal boundary 320. Further, while the product retention edge 350 illustrated herein is shown and discussed as being formed in the peripheral boundary 360 of the primary compartment 300, one with skill in the art can appreciate that a similar objective may be achieved through the use of an additional seal interior to the peripheral boundary 360.

The fold-over line 700 may be identified on the pouch 50 in any of a number of ways. First, the fold-over line 700 may not be expressly identified at all, but rather be implicitly identified by the location and orientation of the tear promoting surface condition 600. For instance in the embodiment of FIG. 1, most adults would recognize that a tear promoting surface condition 600 that does not extend all the way to an edge would most easily be accessed by folding the pouch 50 lengthwise, or substantially orthogonal to the tear promoting surface condition 600, as seen in FIGS. 2 and 3. Alternatively, the pouch 50 may further include indicia 710 located substantially on the fold-over line 700 to indicate how to fold the pouch 50. Such indicia 710 may simply be a line as shown in FIG. 1, or may incorporate a written message such as "fold along line and tear," as seen in FIG. 9.

Yet another embodiment of the peelable pouch 50 incorporates a secondary compartment 400, illustrated in FIGS. 10 through 17 Similar to the primary compartment 300, the secondary compartment 400 is formed between the top layer 100 and the bottom layer 200 by the top layer 100 being selectively joined to the bottom layer 200 by the seal 500. The secondary compartment 400 is adjacent to the primary compartment 300 and separated from the primary compartment 300 by a portion of the seal 500. The secondary compartment 400 has a peripheral boundary 450 along the seal 500.

Figure 11:
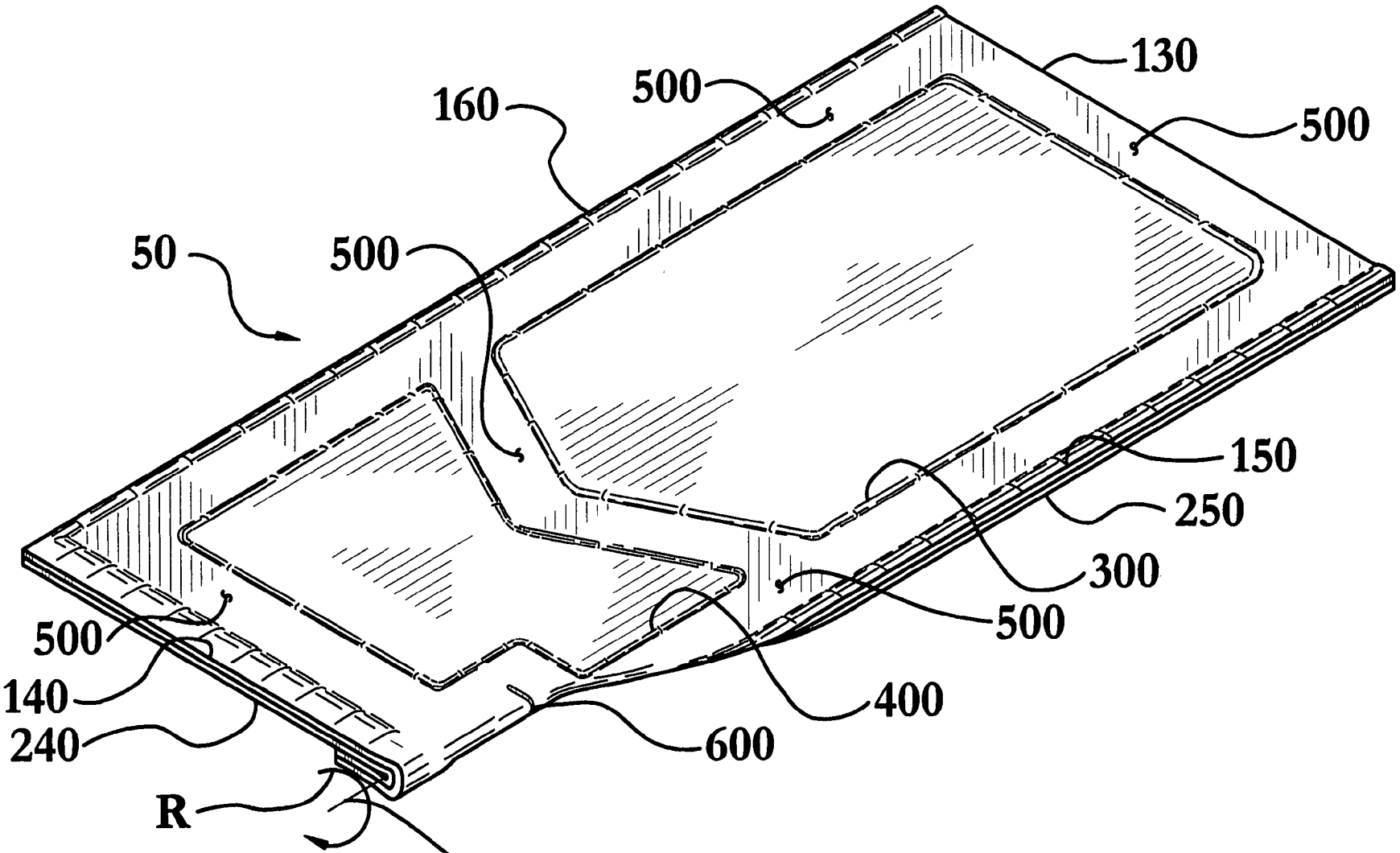
FIG. 11 shows a representative dual compartment peelable pouch in elevated perspective view folded along the fold line, not to scale.
Figure 12:
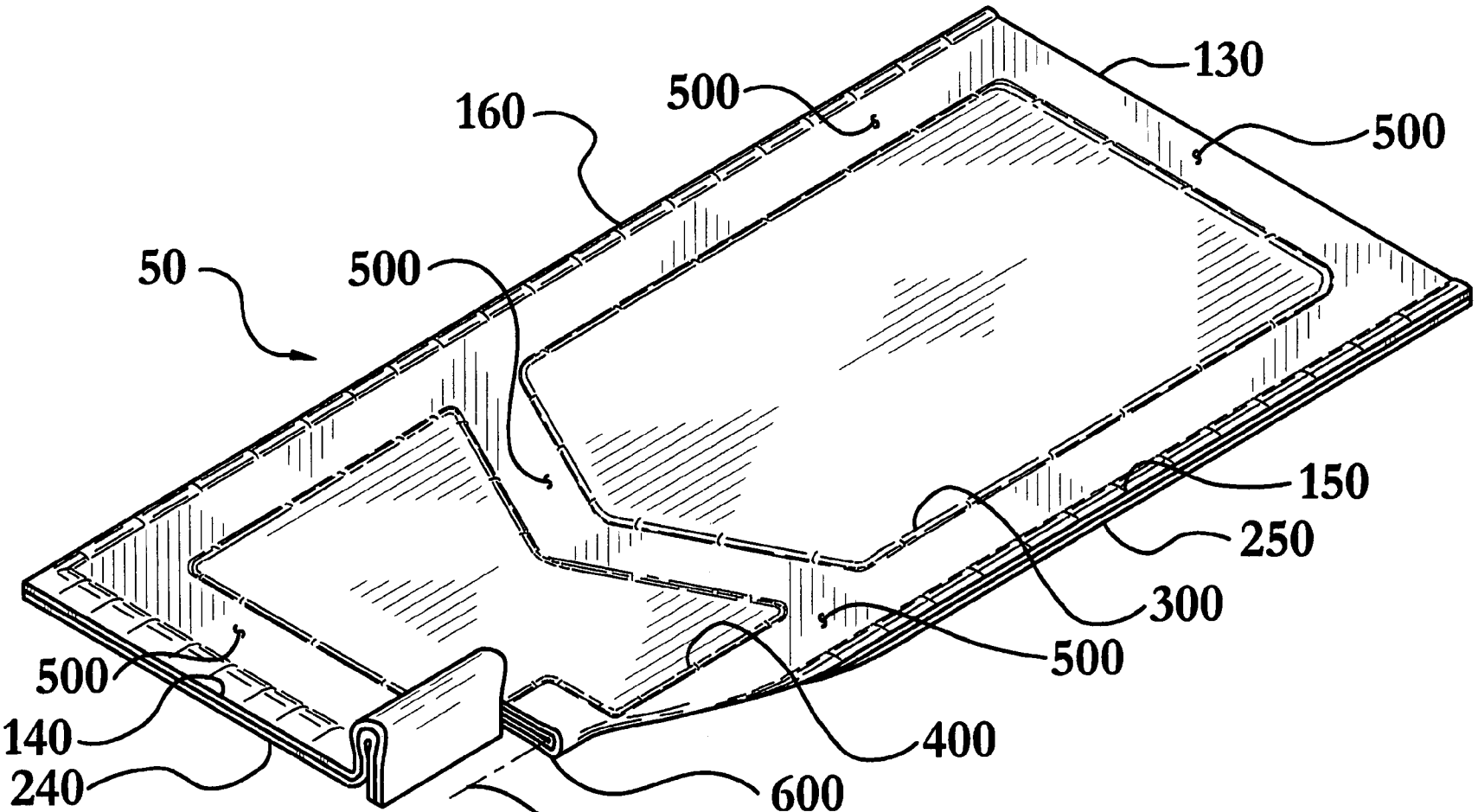
FIG. 12 shows a representative dual compartment peelable pouch in elevated perspective view having an end portion folded with tearing initiated, not to scale.
Figure 13:
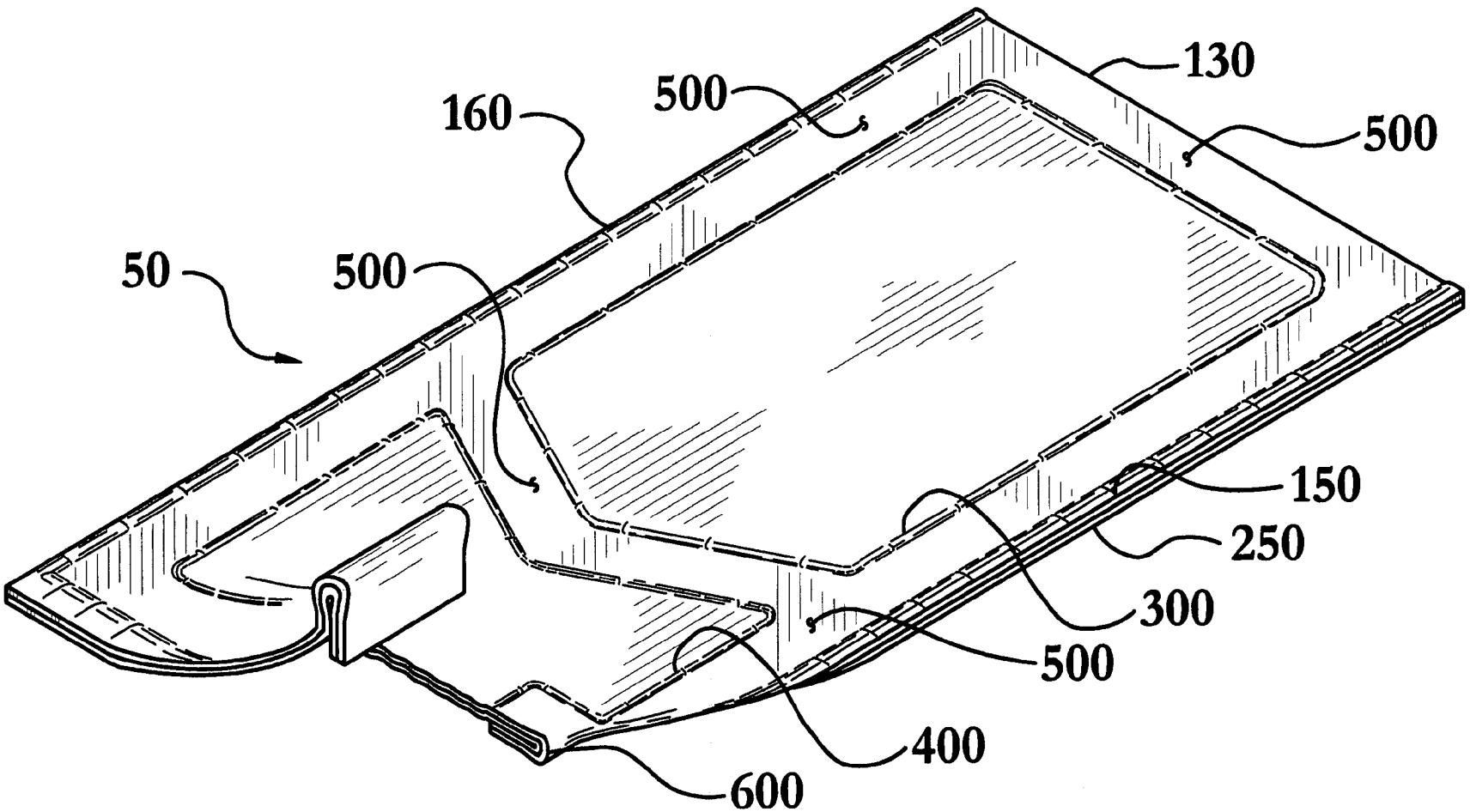
FIG. 13 shows a representative dual compartment peelable pouch partially torn in elevated perspective view, not to scale.
Figure 14:
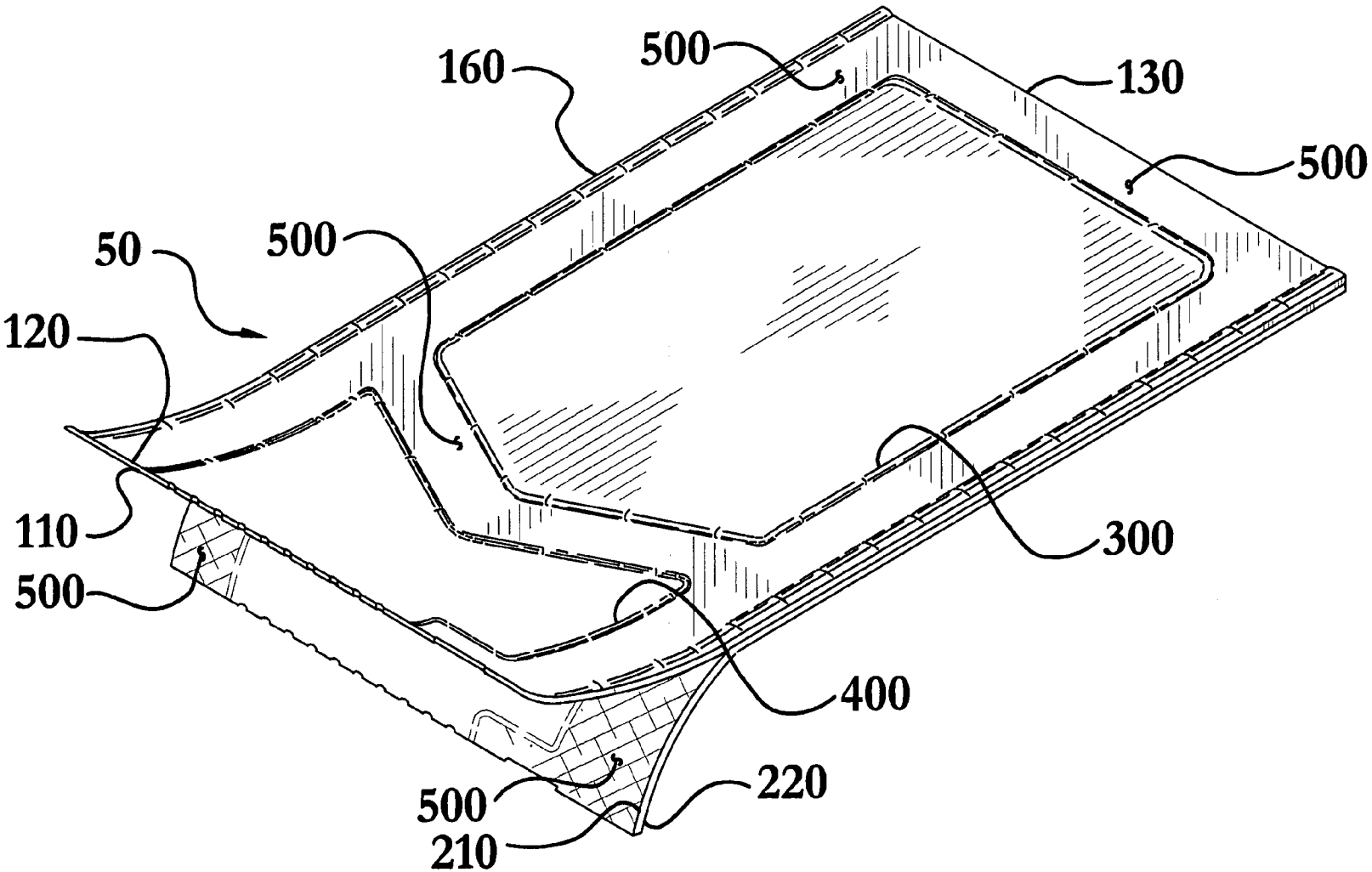
FIG. 14 shows a representative dual compartment peelable pouch fully torn and partially opened in elevated perspective view, not to scale.

In this embodiment, the tear promoting surface condition 600 is configured to promote a tear across a portion of the secondary compartment 400 rather than the primary compartment 300, as in the previous embodiments. Therefore, when the pouch 50 is folded about the fold-over line 700, as seen in FIG. 11, the tear promoting surface condition 600 presents itself and permits a user to fold the end of the pouch 50 so that it may be easily gripped, as seen in FIG. 12. The user may then easily tear off a portion of the top 100 and bottom 200 layers to expose a portion of the secondary compartment 400, rather than the primary compartment 300 where the product P is housed, illustrated in FIG. 13. Once a portion of the secondary compartment 400 is exposed, a user may easily grip the top surface 100 and the bottom surface 200 to peel them apart, as seen in FIG. 14, and separate the portion of the seal 500 separating the primary compartment 300 from the secondary compartment 400, thereby gaining access to the product P. This dual compartment embodiment enhances the child-resistance of the pouch 50 and improves the integrity of the packaging since at least two seals must be compromised before the product P is exposed to the surrounding environment.

Figures 15, 16:
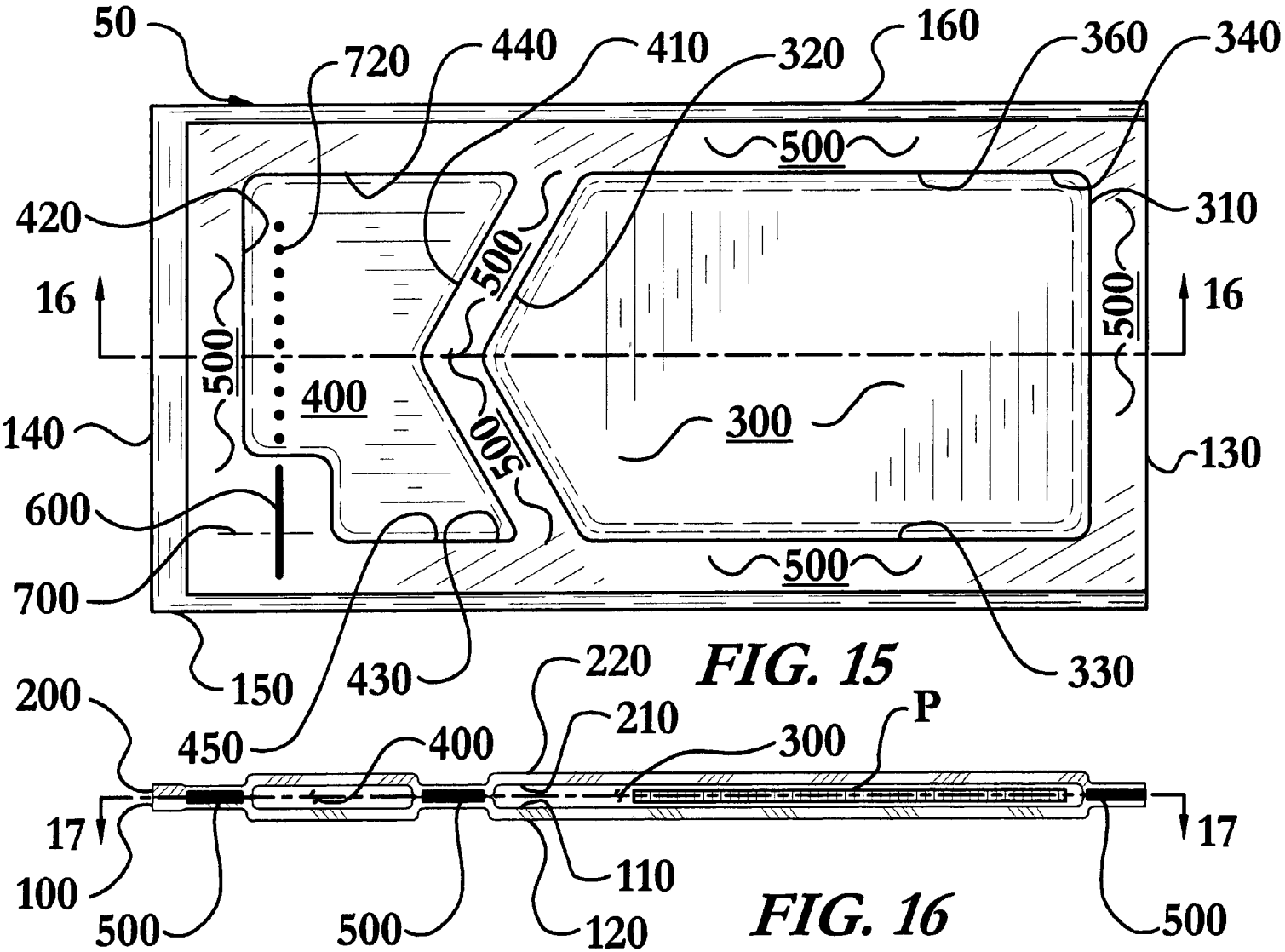
FIG. 15 shows a top plan view of the peelable pouch shown in FIG. 10, not to scale.
FIG. 16 shows a cross-sectional view, taken along section line 16-16 in FIG. 15, not to scale.
Figure 17:
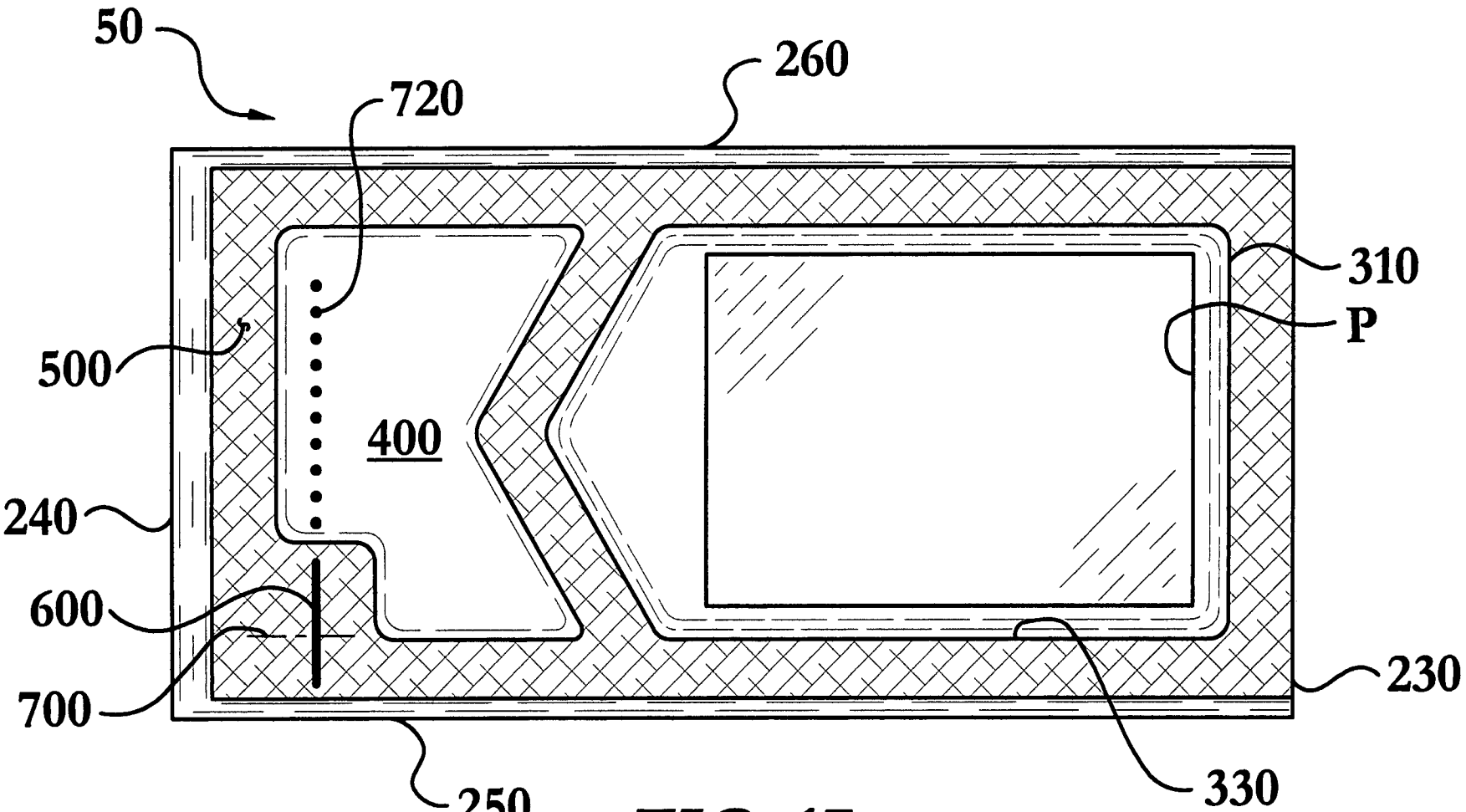
FIG. 17 shows a cross-sectional view, taken along section line 17-17 in FIG. 16, not to scale.
Figure 18:
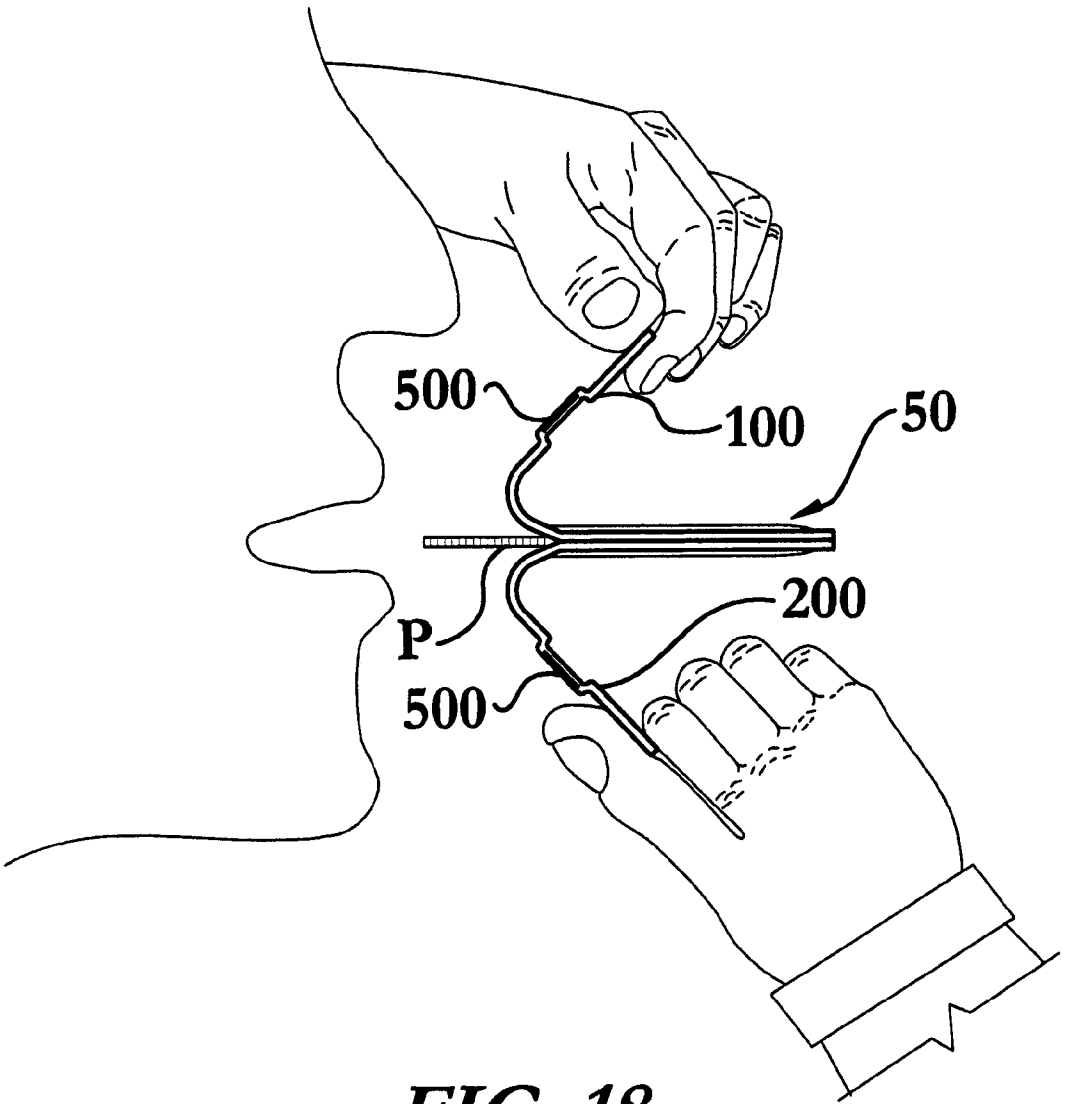
FIG. 18 shows a person opening the peelable pouch in preparation of consumption of the film.

The separation of the product P in the primary compartment 300 from the secondary compartment 400 permits the incorporation of perforations 720 across the secondary compartment 400 in the preferred location for the tear, as illustrated in FIG. 15. Such perforations 720 make the tear easier to perform and provide enhanced control over the location of the tear. The perforations 720 may extend through the top layer 100 and the bottom layer 200 permitting the exterior environment to enter the secondary compartment 400 while the product P in the primary compartment 300 remains sealed and protected from potential contaminants.

A further advantage of the dual compartment embodiment is that the secondary compartment 400 may house a second product. For example, one can readily appreciate that the secondary compartment 400 may house an antibacterial hand washing solution that may be used to clean a user's hands prior to handling the product P in the primary compartment 300.

As discussed previously, the top layer 100 and the bottom layer 200 may be constructed of virtually any material. Embodiments of the pouch 50 directed to the medical market are typically constructed of flexible laminated foil material, and may incorporate a peelable polymer. These foils or films are well known to those skilled in the art and are available commercially from a number of suppliers. Such materials may be impervious to moisture. Alternatively, embodiments directed toward non-prescription products for the mass market, such as breath films and other candies may be constructed of less expensive alternatives.

The inventors will now disclose how the pouch 50 described above may be part of a process to place single dosage forms of a wide variety of product types, in individual pouches. Such a process would, overall, utilize the steps of providing bulk single dosage product while concurrently providing two opposing sheets of pouch material in a suitable packaging machine. A plurality of single dosage products P would be placed between the two opposing sheets of pouch material comprising a top layer 100 and bottom layer 200 in a predetermined pattern, creating areas wherein the top layer 100 and bottom layer 200 of pouch material are separated by single dosage product P and areas where the top layer 100 and bottom layer 200 of pouch film material may directly touch.

The pouches containing the single dosage product P would be formed by applying sealing means to a portion of the top layer 100 and bottom layer 200 of pouch film material such that sealing will occur in areas where top layer 100 and bottom layer 200 of pouch material may directly touch without intervening product. The result would be to seal a portion of the top layer 100 and bottom layer 200 of pouch material to enclose at least one of a plurality of the single dosage products P in at least one closed pouch, sealed from the environment, thereby creating a plurality of closed pouches further comprising a primary compartment 300 containing the single dosage product P. The sealing means may be a thermal means, or any of a variety of sealing techniques that would be known to one skilled in the art. In another embodiment, the sealing means may create a secondary compartment 400, which may increase the child resistant opening nature of the pouch, as described above.

The remaining stages of the process may include forming a tear promoting surface condition 600 in each of the plurality of closed pouches to aid in the later opening of the pouches, and then cutting the plurality of closed pouches into a plurality of individual closed pouches 50. The plurality of individual closed pouches 50 could then be discharged, ready for secondary packaging. The order of the steps of the process may be varied somewhat, as would be apparent to one skilled in the art. By way of example and not limitation, the tear promoting surface condition 600 could be formed either before or after the sealing step.

The tear promoting surface condition 600 may further be formed with a fold-over line 700 that intersects the tear promoting condition 600 such that when the pouch 50 is folded along the fold-over line 700 the tear promoting surface condition 600 presents itself to a user so that it can be easily folded back, as seen in FIG. 3 and FIG. 12, for easy gripping. The tear promoting surface condition 600 permits a user to easily tear off a portion of the top 100 and bottom layer 200 and expose a portion of the primary compartment 300. The location of the fold-over line 700 may be based upon the type of tear promoting surface condition 600 that is incorporated into the pouch 50, as well as the desired level of child-resistance.

The process may further include the step of imprinting indicia on the single dosage product P before sealing as well as further including the step of imprinting indicia 710 on the pouch material either before or after sealing. Indicia 710 imprinted on the pouch material could identify the tear promoting surface condition. Indicia 710 may also identify the product P should the individual pouches 50 be separated from the secondary packaging, while indicia imprinted on the single dosage product P itself could serve as a safety check for the consumer before use and as a reassurance that the product P had been properly identified during packaging.

The pouch 50 as detailed above may be further contemplated as an embodiment for sealing single dosage film strips of orally consumable film in individual pouches. Such a process may involve the steps of first providing bulk orally consumable film strip cast in roll form, and then unwinding the orally consumable film strip under tension in a suitable machine. The roll form may further be formed of a laminate comprising an orally consumable film strip and a release liner such as paper backing wherein the film strip and paper backing are simultaneously unwound.

The bulk film strip may then be slit or otherwise cut into a plurality of strips of lesser width, and each of the strips may then be cut into a plurality of single dosage film strips, each representing a single dosage product P.

The process may then concurrently provide two opposing sheets of pouch material comprising a top layer 100 and bottom layer 200 and placing a plurality of single dosage film strips between the top layer 100 and bottom layer 200 of pouch material in a predetermined pattern. The pattern could create areas wherein the top layer 100 and bottom layer 200 of pouch film material are separated by single dosage film strips and areas where the top layer 100 and bottom layer 200 of pouch film material may directly touch.

The application of sealing means to a portion of the top layer 100 and bottom layer 200 in areas where the top layer 100 and bottom layer 200 of pouch material are directly touching will create a pouch to enclose the single dosage film strip. The sealing means may be a thermal means.

The remaining stages of the process includes forming a tear promoting surface condition 600 in each of the closed pouches and then cutting the plurality of closed pouches into a plurality of individual closed pouches 50. The plurality of individual closed pouches 50 will then be discharged and ready for secondary packaging. The order of the steps of the process may be varied somewhat, as would be apparent to one skilled in the art. By way of example and not limitation, the tear promoting surface condition 600 could be formed either before or after the sealing step.

The tear promoting surface condition 600 may further be formed of a feature on the top layer 100 and the bottom layer 200. The tear promoting surface condition 600 may be configured so that a tear that originates therefrom traverses a portion of the primary compartment 300 thereby removing a portion of the top 100 and bottom layer 200 to expose a portion of the primary compartment 300. The fold-over line 700 may intersect the tear promoting surface condition 600 at virtually any angle despite the figures illustrating the intersection as substantially orthogonal.

The process may further include the step of imprinting indicia on the single dosage film strip before sealing as well as further including the step of imprinting indicia 710 on pouch material either before or after sealing. Indicia 710 imprinted on the pouch material could identify the dosage form should the individual pouches be separated from the secondary packaging, while indicia imprinted on the single dosage film strip itself could serve as a safety check for the consumer.

The process can also be adapted to create a child-resistant package. For example, the sealing process can be used to create a closed pouch 50 which requires simultaneous or complex movement sequences to open the package. One such adaptation is the combination of a primary 300 and a secondary compartment 400 in the pouch 50 as detailed above.

INDUSTRIAL APPLICABILITY

The peelable pouch according to the present invention answers a long felt need for a low cost disposable package for housing a single film dosage form. The present invention provides a package that offers simplicity in manufacture, convenience in storage, preservation of product, resistance to contamination, child-resistance, and improved sanitation. In particular, the inventive package has the capacity to provide a means for safely delivering thin film dosage forms while at the same time creating efficient child resistant packaging.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations.

We claim:

1. A peelable pouch for containing at least one thin film dosage form of a product, comprising:

a top layer having a peripheral edge, an interior surface, and an exterior surface;

a bottom layer having a peripheral edge, an interior surface, and an exterior surface;

a planar primary compartment configured to house the at least one thin film dosage form of the product in a substantially flat manner, sealed from the exterior environment, formed between the top layer and the bottom layer by the top layer being peelably sealed to the bottom layer, the planar primary compartment having a peripheral boundary along the seal; and a tear promoting surface condition on the top layer and the bottom layer intersecting a fold-over line such that when the pouch is folded about the fold-over line the tear promoting surface condition permits a user to perform a controlled tear of a proximal boundary of the planar primary compartment along a transverse axis perpendicular to opposing lateral edges of the planar primary compartment, wherein the controlled tear performed by the user tears off a portion of the top and bottom layer and subsequently exposes a proximal end of the planar primary compartment.

2. The pouch of claim 1, further including a product retention edge formed in the peripheral boundary of the planar primary compartment and configured such that the at least one thin film dosage form of the product is retained in the planar primary compartment after the proximal end of the planar primary compartment has been exposed, and further such that the top layers and the bottom layers must be partially peeled apart along the seal in the vicinity of the product retention edge to remove the product.

3. The pouch of claim 2, wherein the top layer has a proximal edge, a distal edge, a first lateral edge, and a second lateral edge, the bottom layer has a proximal edge, a distal edge, a first lateral edge, and a second lateral edge, and the seal joins the proximal edges, the distal edges, the first lateral edges, and the second lateral edges of the top layer and the bottom layer thereby defining the planar primary compartment peripheral boundary to include the proximal boundary, a distal boundary, a first lateral boundary, and a second lateral boundary, wherein once the proximal boundary is torn away, the portion of the seal creating the product retention edge must be unpeeled in order to remove the at least one thin film dosage form of the product from the planar primary compartment.

4. The pouch of claim 2, wherein the top layer has a proximal edge, a distal edge, a first lateral edge, and a second lateral edge, the bottom layer has a proximal edge, a distal edge, a first lateral edge, and a second lateral edge, and wherein the top layer and the bottom layer are formed from a common substrate folded over at either the proximal edge, the distal edge, the first lateral edge or the second lateral edge creating a folded edge thereby not requiring a seal along the folded edge, whereby the three sealed edges and the folded edge define the planar primary compartment peripheral boundary to include the proximal boundary, a distal boundary, a first lateral boundary, and a second lateral boundary, wherein once the proximal boundary is torn away the portion of the seal creating the product retention edge must be unpeeled in order to remove the at least one thin film dosage form of the product from the planar primary compartment.

5. The pouch of claim 1, wherein the tear promoting surface condition is a tear slit that extends through the top layer and the bottom layer in an area of the seal.

6. The pouch of claim 1, further including indicia substantially on the fold-over line to indicate how to fold the pouch.

7. The pouch of claim 1, wherein the top layer and the bottom layer are constructed of flexible laminated foil material.

8. The pouch of claim 1, wherein the seal is a thermal seal.

9. The pouch of claim 1, wherein the fold-over line substantially orthogonally intersects the tear promoting surface condition.

10. A peelable pouch for containing a single thin film dosage form of a product, comprising:

a top layer having a peripheral edge, an interior surface, and an exterior surface;

a bottom layer having a peripheral edge, an interior surface, and an exterior surface;

a planar primary compartment configured to house the single thin film dosage form of the product in a substantially flat manner, sealed from the exterior environment, formed between the top layer and the bottom layer by the top layer being selectively joined to the bottom layer by a seal, the planar primary compartment having a peripheral boundary along the seal;

a secondary compartment formed between the top layer and the bottom layer by the top layer being peelably joined to the bottom layer by the seal, the secondary compartment being adjacent to the planar primary compartment and separated from the planar primary compartment by a portion of the seal, the secondary compartment having a peripheral boundary along the seal; and a tear promoting surface condition on the top layer and the bottom layer intersecting a fold-over line such that when the pouch is folded about the fold-over line the tear promoting surface condition permits a user to perform a controlled tear of a proximal boundary of the secondary compartment along a traverse axis perpendicular to opposing lateral edges of the secondary compartment, wherein the controlled tear performed by the user tears off a portion of the top and bottom layer and subsequently exposes a proximal end of the secondary compartment so that a user may easily grip the top surface and the bottom surface to peel them apart to separate the portion of the seal separating the planar primary compartment from the secondary compartment, thereby gaining access to the single thin film dosage form of the product.

11. The pouch of claim 10, wherein the tear promoting surface condition is a tear slit that extends through the top layer and the bottom layer in an area of the seal.

12. The pouch of claim 10, further including indicia substantially on the fold-over line to indicate how to fold the pouch.

13. The pouch of claim 10, further including a plurality of perforations through the top layer and the bottom layer substantially along the fold-over line to indicate where to fold the pouch and to improve the tearability of the pouch along the fold-over line.

14. The pouch of claim 10, wherein the top layer has a proximal edge, a distal edge, a first lateral edge, and a second lateral edge, the bottom layer has a proximal edge, a distal edge, a first lateral edge, and a second lateral edge, and the seal joins the proximal edges, the distal edges, the first lateral edges, and the second lateral edges of the top layer and the bottom layer thereby defining the planar primary compartment peripheral boundary to include a proximal boundary, a distal boundary, a first lateral boundary, and a second lateral boundary, and defining the secondary compartment peripheral boundary to include the proximal boundary, a distal boundary, a first lateral boundary, and a second lateral boundary, wherein once the proximal boundary of the secondary compartment is torn away, a user may grip the top surface and the bottom surface to peel them apart to separate the portion of the seal separating the planar primary compartment from the secondary compartment, thereby gaining access to the single thin film dosage form of the product.

15. The pouch of claim 10, wherein the top layer has a proximal edge, a distal edge, a first lateral edge, and a second lateral edge, the bottom layer has a proximal edge, a distal edge, a first lateral edge, and a second lateral edge, and wherein the top layer and the bottom layer are a formed from a common substrate folded over at either the proximal edge, the distal edge, the first lateral edge, or the second lateral edge creating a folded edge thereby not requiring the seal along the folded edge, whereby the three sealed edges and the folded edge define the planar primary compartment peripheral boundary to include a proximal boundary, a distal boundary, a first lateral boundary, and a second lateral boundary, and define the secondary compartment peripheral boundary to include the proximal boundary, a distal boundary, a first lateral boundary, and a second lateral boundary, wherein once the proximal boundary of the secondary compartment is torn away, a user may easily grip the top surface and the bottom surface to peel them apart to separate the portion of the seal separating the planar primary compartment from the secondary compartment, thereby gaining access to the single thin film dosage form of the product.

16. The pouch of claim 10, wherein the top layer and the bottom layer are constructed of flexible laminated foil material.

17. The pouch of claim 10, wherein the seal is a thermal seal.

18. The pouch of claim 10, wherein the fold-over line substantially orthogonally intersects the tear promoting surface condition.

19. A peelable pouch for containing at least one thin film dosage form of a product, comprising:

a top layer having a peripheral edge, an interior surface, and an exterior surface;

a bottom layer having a peripheral edge, an interior surface, and an exterior surface;

a primary compartment configured to house the at least one thin film dosage form of the product, sealed from the exterior environment, formed between the top layer and the bottom layer by the top layer being peelably sealed to the bottom layer, the primary compartment having a peripheral boundary along the seal;

a product retention edge formed in the peripheral boundary of the primary compartment, wherein a section of the product retention edge at a peelable proximal end of the pouch is configured such that the proximal end of the pouch has a width narrower than the at least one thin film dosage form of the product; and a tear promoting surface condition on the top layer and the bottom layer intersecting a fold-over line such that when the pouch is folded about the fold-over line the tear promoting surface condition permits a user to tear off a portion of the top and bottom layer and expose a portion of the primary compartment.

20. The pouch of claim 19, wherein the product retention edge formed in the peripheral boundary of the primary compartment is configured to retain the at least one thin film dosage form of the product in the primary compartment after the primary compartment has been exposed to the exterior environment by the removal of a portion of the top layer and the bottom layer along the fold-over line such that the top layers and the bottom layers must be partially peeled apart along the seal in the vicinity of the product retention edge to remove the product.

* * * * *